US012422171B2

(12) United States Patent
Kumakura et al.

(10) Patent No.: US 12,422,171 B2
(45) Date of Patent: Sep. 23, 2025

(54) REFRIGERATION CYCLE APPARATUS

(71) Applicants: DAIKIN INDUSTRIES, LTD., Osaka (JP); The University of Tokyo, Tokyo (JP)

(72) Inventors: Eiji Kumakura, Osaka (JP); Hirofumi Daiguji, Tokyo (JP); Arun Majumdar, Stanford, CA (US); Wei-Lun Hsu, Tokyo (JP); Jubair Ahmed Shamim, Tokyo (JP)

(73) Assignees: DAIKIN INDUSTRIES, LTD., Osaka (JP); THE UNIVERSITY OF TOKYO, Tokyo (JP)

( * ) Notice: Subject to any disclaimer, the term of this patent is extended or adjusted under 35 U.S.C. 154(b) by 145 days.

(21) Appl. No.: 18/215,031

(22) Filed: Jun. 27, 2023

(65) Prior Publication Data

US 2023/0417460 A1 Dec. 28, 2023

Related U.S. Application Data

(60) Provisional application No. 63/356,370, filed on Jun. 28, 2022.

(51) Int. Cl.

| | |
|---|---|
| ***F25B 25/02*** | (2006.01) |
| ***F25B 9/00*** | (2006.01) |
| ***F25B 15/02*** | (2006.01) |

(52) U.S. Cl.

CPC ..... *F25B 25/02* (2013.01); *F25B 9/008* (2013.01); *F25B 15/02* (2013.01); *F25B 2309/06* (2013.01)

(58) Field of Classification Search

CPC ..... F25B 15/02; F25B 25/02

See application file for complete search history.

(56) References Cited

U.S. PATENT DOCUMENTS 4,724,679 A * 2/1988 Radermacher ..... F25B 9/006 62/101
4,967,566 A * 11/1990 Bergmann ..... F25B 25/02 62/502

(Continued)

FOREIGN PATENT DOCUMENTS

| | | | |
|---|---|---|---|
| JP | 11-63719 | A | 3/1999 |
| JP | 2005-308355 | A | 11/2005 |
| WO | WO 2009/146278 | A1 | 12/2009 |

OTHER PUBLICATIONS

International Search Report for International Application No. PCT/JP2023/023693, dated Sep. 5, 2023, with English translation.

(Continued)

*Primary Examiner* — Christopher R Zerphey

(74) *Attorney, Agent, or Firm* — Birch, Stewart, Kolasch & Birch, LLP

(57) ABSTRACT

A refrigerant circuit includes a compressor that compresses refrigerant and an expansion mechanism that decompresses refrigerant. The refrigerant circuit configures a vapor compression refrigeration cycle in which the refrigerant circulates. The adsorbent adsorbs and desorbs the refrigerant circulating in a first unit. The refrigerant circuit includes a high-pressure region and a low-pressure region. The refrigeration cycle apparatus is operated under at least one of a first condition and a second condition. In the first condition, the refrigerant in the high-pressure region has a pressure lower than or equal to a critical pressure of the refrigerant, and the refrigerant in the high-pressure region has a temperature exceeding a critical temperature of the refrigerant. In the second condition, the refrigerant in the low-pressure region has a pressure lower than a saturation pressure corresponding to an evaporation temperature of the refrigerant in a case where the adsorbent neither adsorbs nor desorbs the refrigerant.

9 Claims, 8 Drawing Sheets

(56) References Cited

U.S. PATENT DOCUMENTS

| | | | | |
|---|---|---|---|---|
| 5,582,020 | A * | 12/1996 | Scaringe | C09K 5/041 62/476 |
| 10,266,737 | B2 * | 4/2019 | Van Horn | C07F 19/005 |
| 10,994,258 | B2 * | 5/2021 | Baumann | F25B 15/00 |
| 2023/0417459 | A1 * | 12/2023 | Kumakura | F25B 9/002 |

OTHER PUBLICATIONS

International Preliminary Report on Patentability and Written Opinion of the International Searching Authority for International Application No. PCT/JP2023/023693, dated Jan. 9, 2025, with English translation.

* cited by examiner

REFRIGERATION CYCLE APPARATUS

CROSS REFERENCE TO RELATED APPLICATIONS

This nonprovisional application claims the benefit of U.S. Provisional Application No. 63/356,370 filed on Jun. 28, 2022. The entire contents of the above application is hereby incorporated by reference.

TECHNICAL FIELD

The present disclosure relates to a refrigeration cycle apparatus.

BACKGROUND ART

Hitherto, a hybrid refrigeration system employing a combination of a vapor compression refrigeration cycle and an adsorption refrigeration cycle has been used. Patent Literature 1 (International Publication No. 2009/145278) discloses a hybrid refrigeration system in which a pair of adsorbers of an adsorption refrigeration cycle are alternately cooled and heated to alternately repeat adsorption and desorption of a refrigerant in order to reduce a mechanical work load of a compressor of a vapor compression refrigeration cycle.

SUMMARY OF THE INVENTION

A hybrid refrigeration system that controls adsorption and desorption of a refrigerant in an adsorption refrigeration cycle by using a change in the pressure of a refrigerant circulating in a vapor compression refrigeration cycle is not conventionally used.

A refrigeration cycle apparatus according to a first aspect includes a first unit and an adsorbent. The first unit includes a compressor that compresses a refrigerant and an expansion mechanism that decompresses the refrigerant. The first unit constitutes a vapor compression refrigeration cycle in which the refrigerant circulates. The adsorbent adsorbs and desorbs the refrigerant circulating in the first unit. The first unit further includes a high-pressure region and a low-pressure region. In the high-pressure region, the refrigerant that has been compressed by the compressor and that has not yet been decompressed by the expansion mechanism flows. In the low-pressure region, the refrigerant that has been decompressed by the expansion mechanism and that has not yet been compressed by the compressor flows. The refrigeration cycle apparatus is operated under at least one of a first condition and a second condition. In the first condition, the refrigerant in the high-pressure region has a pressure lower than or equal to a critical pressure of the refrigerant, and the refrigerant in the high-pressure region has a temperature exceeding a critical temperature of the refrigerant. In the second condition, the refrigerant in the low-pressure region has a pressure lower than a saturation pressure corresponding to an evaporation temperature of the refrigerant in a case where the adsorbent neither adsorbs nor desorbs the refrigerant.

The refrigeration cycle apparatus according to the first aspect has a lower operating pressure than a refrigeration cycle apparatus that has a vapor compression refrigeration cycle and does not have an adsorbent, and is capable of using the adsorption heat and desorption heat of the refrigerant. Thus, the refrigeration cycle apparatus according to the first aspect is capable of reducing the cost and improving the efficiency of the refrigeration cycle.

A refrigeration cycle apparatus according to a second aspect includes a first unit and an adsorbent. The first unit includes a compressor that compresses a refrigerant and an expansion mechanism that decompresses the refrigerant. The first unit constitutes a vapor compression refrigeration cycle in which the refrigerant circulates. The adsorbent adsorbs and desorbs the refrigerant circulating in the first unit. The first unit further includes a high-pressure region and a low-pressure region. In the high-pressure region, the refrigerant that has been compressed by the compressor and that has not yet been decompressed by the expansion mechanism flows. In the low-pressure region, the refrigerant that has been decompressed by the expansion mechanism and that has not yet been compressed by the compressor flows. The refrigeration cycle apparatus is operated under at least one of a first condition and a second condition. In the first condition, the refrigerant in the high-pressure region has a pressure lower than or equal to a critical pressure of the refrigerant, and the refrigerant in the high-pressure region has a temperature exceeding a saturation temperature of the refrigerant corresponding to the pressure of the refrigerant in the high-pressure region. In the second condition, the refrigerant in the low-pressure region has a pressure lower than a saturation pressure corresponding to an evaporation temperature of the refrigerant in a case where the adsorbent neither adsorbs nor desorbs the refrigerant.

The refrigeration cycle apparatus according to the second aspect has a lower operating pressure than a refrigeration cycle apparatus that has a vapor compression refrigeration cycle and does not have an adsorbent, and is capable of using the adsorption heat and desorption heat of the refrigerant. Thus, the refrigeration cycle apparatus according to the second aspect is capable of reducing the cost and improving the efficiency of the refrigeration cycle.

A refrigeration cycle apparatus according to a third aspect is the refrigeration cycle apparatus according to the second aspect, in which the refrigerant in the high-pressure region has a pressure lower than or equal to a saturation pressure corresponding to 65° C. of R32 in a vapor compression refrigeration cycle in which the R32 circulates.

A refrigeration cycle apparatus according to a fourth aspect is the refrigeration cycle apparatus according to the second aspect, in which the refrigerant in the high-pressure region has a pressure lower than or equal to a saturation pressure corresponding to 65° C. of R134a in a vapor compression refrigeration cycle in which the R134a circulates.

A refrigeration cycle apparatus according to a fifth aspect is the refrigeration cycle apparatus according to any one of the second to fourth aspects, in which the adsorbent includes a metal-organic framework including a metal ion and an organic ligand.

A refrigeration cycle apparatus according to a sixth aspect is the refrigeration cycle apparatus according to any one of the second to fifth aspects, in which the refrigerant is carbon dioxide.

A refrigeration cycle apparatus according to a seventh aspect includes a first unit and an adsorbent. The first unit includes a compressor that compresses a refrigerant and an expansion mechanism that decompresses the refrigerant. The first unit constitutes a vapor compression refrigeration cycle in which the refrigerant circulates. The adsorbent adsorbs and desorbs the refrigerant circulating in the first unit. The first unit further includes a high-pressure region and a low-pressure region. In the high-pressure region, the refrigerant that has been compressed by the compressor and that has not yet been decompressed by the expansion mechanism flows. In the low-pressure region, the refrigerant that has been decompressed by the expansion mechanism and that has not yet been compressed by the compressor flows. The refrigeration cycle apparatus is operated under at least one of a first condition and a second condition. In the first condition, the refrigerant in the high-pressure region has a pressure lower than a saturation pressure corresponding to a condensation temperature of the refrigerant in a case where the adsorbent neither adsorbs nor desorbs the refrigerant. In the second condition, the refrigerant in the low-pressure region has a pressure lower than a saturation pressure corresponding to an evaporation temperature of the refrigerant in a case where the adsorbent neither adsorbs nor desorbs the refrigerant.

The refrigeration cycle apparatus according to the seventh aspect has a lower operating pressure than a refrigeration cycle apparatus that has a vapor compression refrigeration cycle and does not have an adsorbent, and is capable of using the adsorption heat and desorption heat of the refrigerant. Thus, the refrigeration cycle apparatus according to the seventh aspect is capable of reducing the cost and improving the efficiency of the refrigeration cycle.

A refrigeration cycle apparatus according to an eighth aspect is the refrigeration cycle apparatus according to the seventh aspect, in which the adsorbent includes a metal-organic framework including a metal ion and an organic ligand.

A refrigeration cycle apparatus according to a ninth aspect is the refrigeration cycle apparatus according to the seventh aspect or the eighth aspect, in which the refrigerant is ammonia or propane.

DESCRIPTION OF EMBODIMENTS (1) Overall Configuration

A refrigeration cycle apparatus 1 includes a hybrid cycle in which a vapor compression cycle and an adsorption cycle are combined. The vapor compression cycle is a vapor compression refrigeration cycle, and is a heat pump cycle that uses transfer of latent heat generated when a refrigerant evaporates and condenses. The adsorption cycle is an adsorption refrigeration cycle, and is a heat pump cycle that uses transfer of latent heat generated when a refrigerant is adsorbed by an adsorbent and when a refrigerant is desorbed from an adsorbent. The refrigeration cycle apparatus 1 is, for example, an air conditioning apparatus and a refrigeration apparatus.

Figure 1:
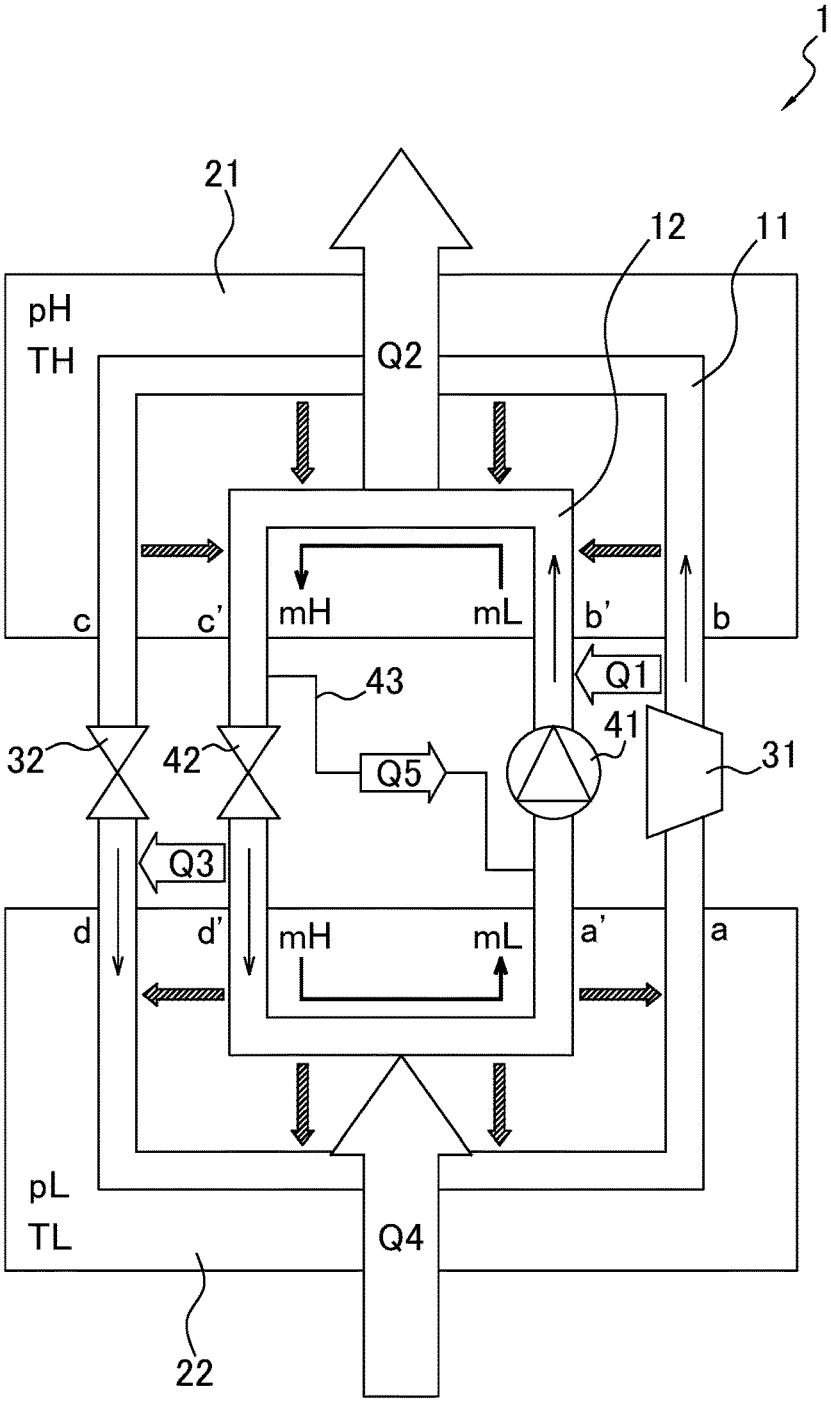
FIG. 1 is a schematic diagram of a hybrid cycle included in a refrigeration cycle apparatus.

As illustrated in FIG. 1, the refrigeration cycle apparatus 1 includes a refrigerant circuit 11 and an adsorption circuit 12. The refrigerant circuit 11 constitutes a vapor compression cycle in which a refrigerant circulates. The adsorption circuit 12 constitutes an adsorption cycle in which an adsorbent circulates.

The refrigeration cycle apparatus 1 may include only one circuit having the function of at least one of the refrigerant circuit 11 and the adsorption circuit 12. In this case, the refrigeration cycle apparatus 1 may include a circuit in which a mixture of a refrigerant and an adsorbent circulates. Alternatively, the refrigeration cycle apparatus 1 may include a circuit in which only a refrigerant circulates and which includes a mechanism for bringing a circulating refrigerant into contact with an adsorbent. In this case, the adsorbent is not circulated.

The refrigeration cycle apparatus 1 may include two circuits composed of a circuit having the function of the refrigerant circuit 11 and a circuit having the function of the adsorption circuit 12. In this case, the refrigeration cycle apparatus 1 includes a mechanism for bringing the refrigerant circulating in the refrigerant circuit 11 into contact with the adsorbent circulating in the adsorption circuit 12. In FIG. 1, the refrigerant circuit 11 and the adsorption circuit 12 are illustrated as independent circuits for the sake of description.

The refrigeration cycle apparatus 1 includes an adsorption section 21 and a desorption section 22. The adsorption section 21 and the desorption section 22 each include a part of the refrigerant circuit 11 and a part of the adsorption circuit 12. In the adsorption section 21 and the desorption section 22, a refrigerant is able to freely move between the refrigerant circuit 11 and the adsorption circuit 12. An adsorbent is unable to move between the refrigerant circuit 11 and the adsorption circuit 12. In the adsorption section 21, the refrigerant that has flowed into the adsorption circuit 12 from the refrigerant circuit 11 is adsorbed by the adsorbent flowing in the adsorption circuit 12. In the desorption section 22, the refrigerant desorbed from the adsorbent flowing in the adsorption circuit 12 flows into the refrigerant circuit 11 from the adsorption circuit 12.

The refrigerant circuit 11 includes a compressor 31 and an expansion mechanism 32. The compressor 31 compresses the refrigerant circulating in the refrigerant circuit 11. The expansion mechanism 32 decompresses the refrigerant circulating in the refrigerant circuit 11. The compressor 31 is, for example, a rotary compressor. The expansion mechanism 32 is, for example, an electronic expansion valve. In the refrigerant circuit 11, a refrigerant is compressed by the compressor 31, passes through the adsorption section 21, is decompressed by the expansion mechanism 32, passes through the desorption section 22, and is compressed again by the compressor 31.

The refrigerant circuit 11 includes a high-pressure region and a low-pressure region. In the high-pressure region, a refrigerant that has been compressed by the compressor 31 and that has not yet been decompressed by the expansion mechanism 32 flows. In the low-pressure region, a refrigerant that has been decompressed by the expansion mechanism 32 and that has not yet been compressed by the compressor 31 flows. The high-pressure region corresponds to a part of the refrigerant circuit 11 included in the adsorption section 21. The low-pressure region corresponds to a part of the refrigerant circuit 11 included in the desorption section 22.

The refrigerant circulating in the refrigerant circuit 11 is carbon dioxide. The refrigerant may be ammonia or propane.

The adsorption circuit 12 includes a pressurizer 41 and a depressurizer 42. The pressurizer 41 pressurizes the adsorbent circulating in the adsorption circuit 12. The depressurizer 42 depressurizes the adsorbent circulating in the adsorption circuit 12. The pressurizer 41 is, for example, a powder pump. The depressurizer 42 is, for example, a powder valve. In the adsorption circuit 12, an adsorbent is pressurized by the pressurizer 41, passes through the adsorption section 21, is depressurized by the depressurizer 42, passes through the desorption section 22, and is pressurized again by the pressurizer 41. Depending on the configuration of the refrigeration cycle apparatus 1, the adsorption circuit 12 need not include the pressurizer 41 and the depressurizer 42.

The adsorption circuit 12 may further include a heat exchanger 43. The heat exchanger 43 exchanges heat between the upstream side of the pressurizer 41 and the upstream side of the depressurizer 42. The heat exchanger 43 gives a part of the heat of the adsorbent flowing between the adsorption section 21 and the depressurizer 42 to the adsorbent flowing between the desorption section 22 and the pressurizer 41.

The adsorbent circulating in the adsorption circuit 12 includes a metal-organic framework including a metal ion and an organic ligand. A metal-organic framework (MOF) is a porous material that has a very large specific surface and that is obtained by a reaction of a metal ion and an organic ligand. In the MOF, an organic ligand is linked to a metal ion, and thereby a polymer structure having innumerable voids therein is obtained. In the MOF, the void diameter and topology can be adjusted by selecting and combining a metal ion and an organic ligand. In the MOF, the void diameter can be adjusted and a target substance can be selectively adsorbed by selecting and combining a metal ion and an organic ligand. The MOF is used as, for example, a porous material having a function of selectively storing and separating molecules and ions. In the present embodiment, the MOF is used as an adsorbent for adsorbing and desorbing a refrigerant. The MOF includes, for example, MOF-5 and MOF-200. The adsorbent is, for example, a powder of an MOF.

(2) Operation

The adsorbent adsorbs and desorbs the refrigerant circulating in the refrigerant circuit 11. The adsorbent adsorbs and desorbs the refrigerant in accordance with a change in the pressure of the refrigerant circulating in the refrigerant circuit 11. Specifically, the adsorbent adsorbs the refrigerant under high pressure, and desorbs the refrigerant under low pressure.

It is assumed that the high-pressure region of the refrigerant circuit 11 is filled with a refrigerant having a pressure pH and a temperature TH. It is assumed that the low-pressure region of the refrigerant circuit 11 is filled with a refrigerant having a pressure pL and a temperature IL. The pressure pH is higher than the pressure pL. The temperature TH is higher than the temperature TL. The adsorbent adsorbs the refrigerant in the high-pressure region of the refrigerant circuit 11. The adsorbent desorbs the refrigerant in the low-pressure region of the refrigerant circuit 11. In the adsorption section 21, the refrigerant flowing in the high-pressure region of the refrigerant circuit 11 flows into the adsorption circuit 12 and is adsorbed by the adsorbent. In the desorption section 22, the refrigerant desorbed from the adsorbent flowing in the adsorption circuit 12 flows into the low-pressure region of the refrigerant circuit 11.

Figure 2:
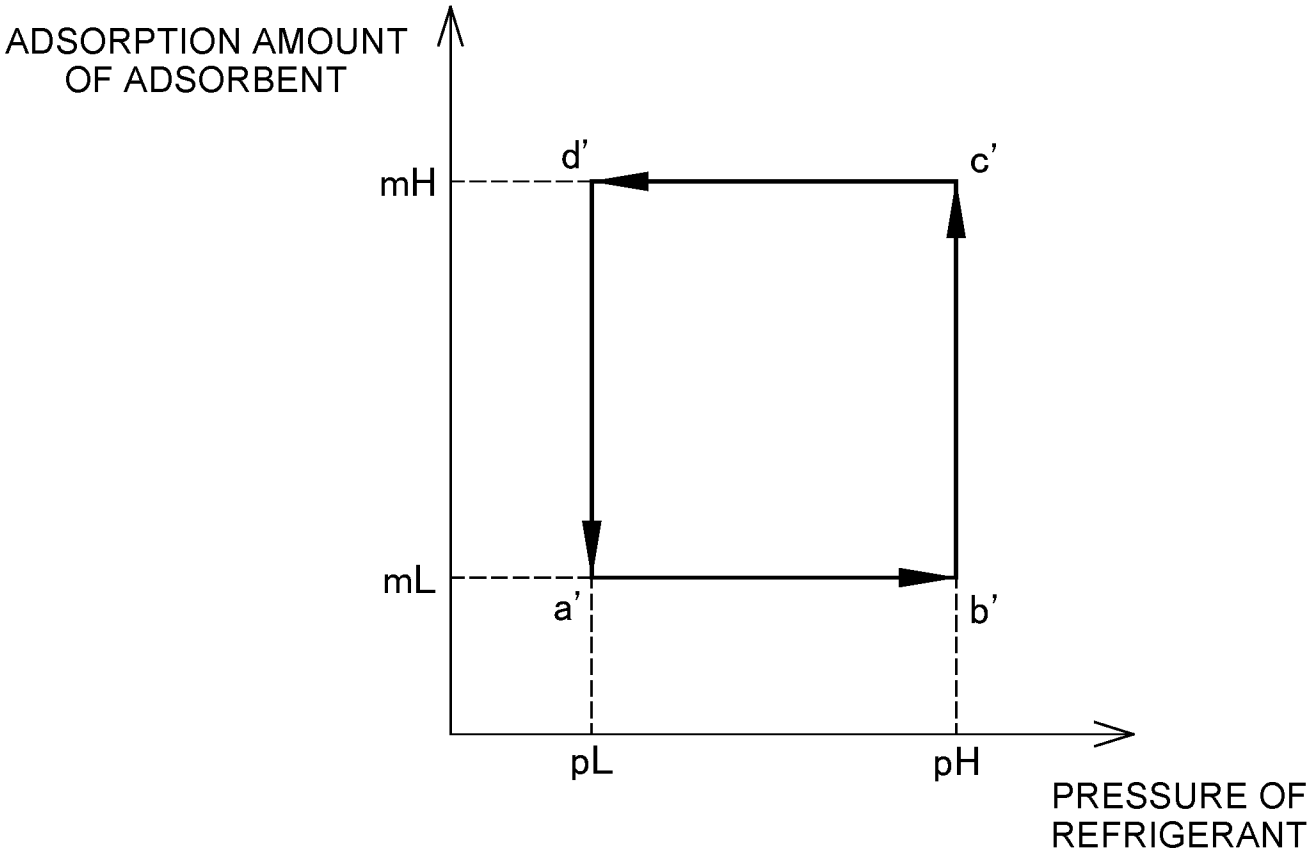
FIG. 2 is a graph illustrating the relationship between the adsorption amount of an adsorbent and the pressure of a refrigerant.
Figure 3:
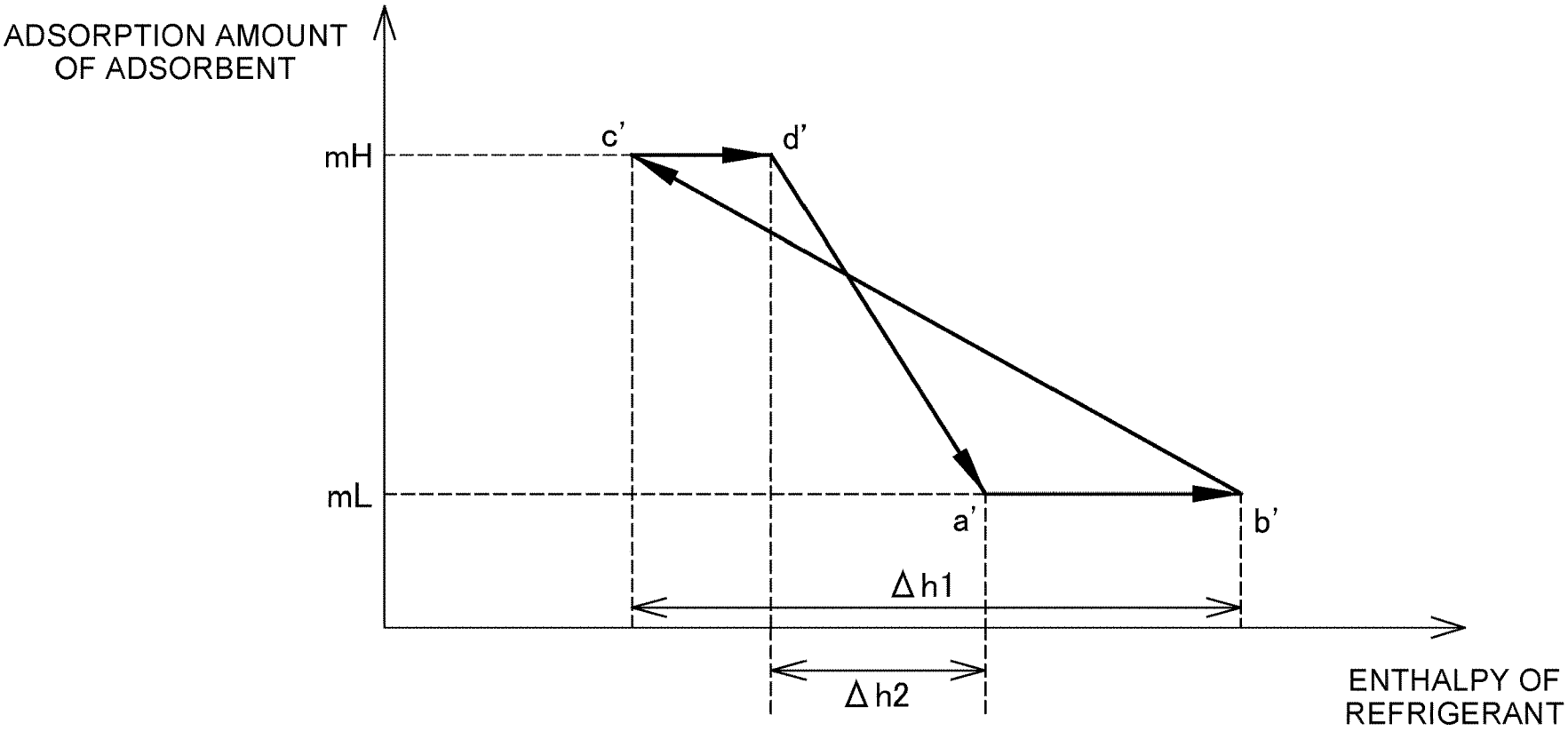
FIG. 3 is a graph illustrating the relationship between the adsorption amount of an adsorbent and the enthalpy of a refrigerant.
Figure 4:
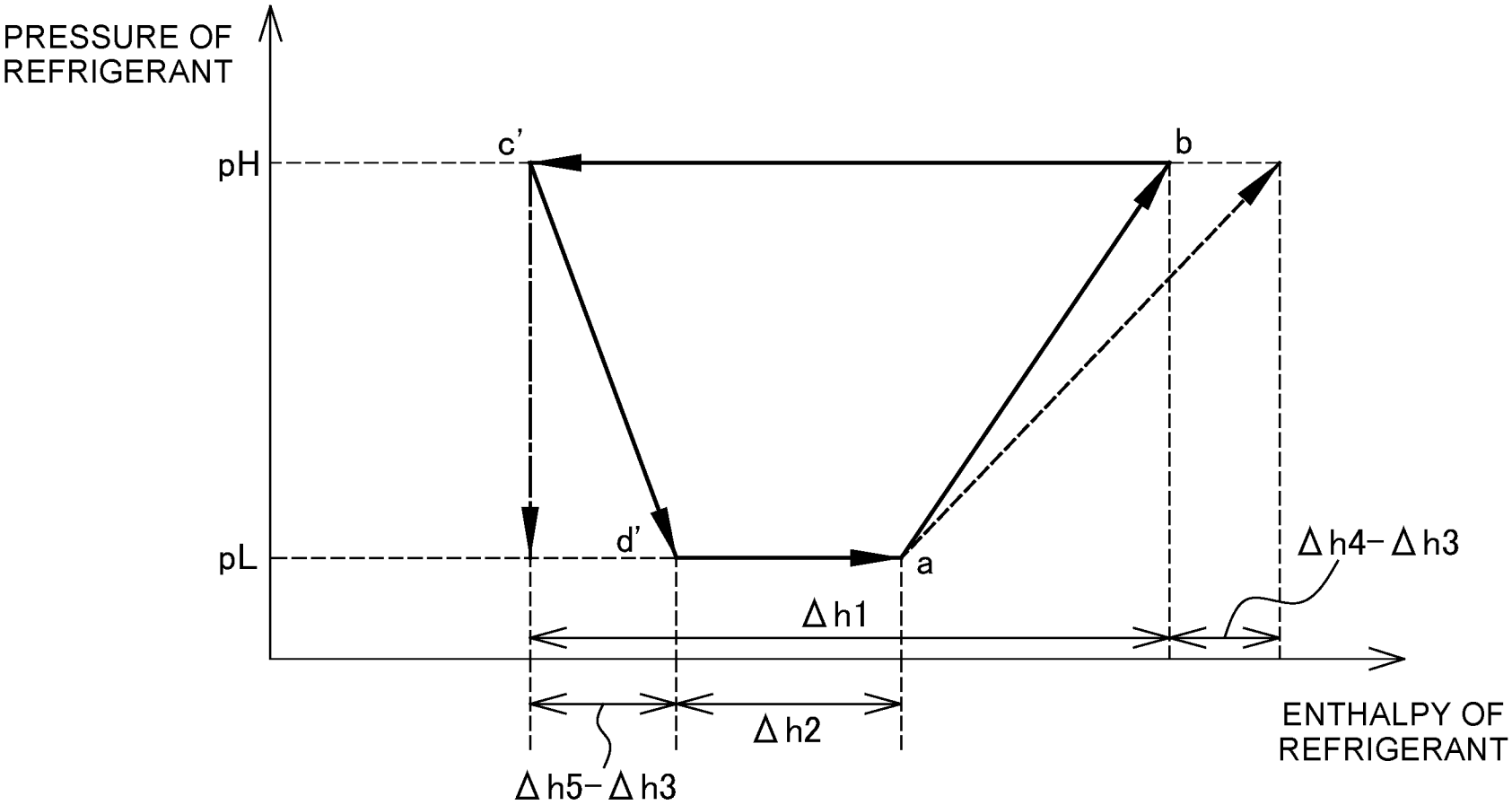
FIG. 4 is a graph illustrating the relationship between the pressure of a refrigerant and the enthalpy of the refrigerant.

The operation of a heat pump cycle of the refrigeration cycle apparatus 1 will be described with reference to FIGS. 1 to 4. FIGS. 1 to 4 illustrate a refrigerant cycle in the refrigerant circuit 11 and an adsorbent cycle in the adsorption circuit 12. The graph in FIG. 2 illustrates changes in an adsorption amount, which is the mass of the refrigerant adsorbed by the adsorbent per unit mass, and the pressure of the refrigerant adsorbed by the adsorbent in the heat pump cycle. The graph in FIG. 3 illustrates changes in the adsorption amount of the adsorbent and the enthalpy of the refrigerant adsorbed by the adsorbent in the heat pump cycle. The graph in FIG. 4 illustrates changes in the pressure of the refrigerant and the enthalpy of the refrigerant in the heat pump cycle. It is assumed that, in the refrigeration cycle apparatus 1, heat can freely transfer between the refrigerant circuit 11 and the adsorption circuit 12.

In the refrigerant circuit 11, the refrigerant is compressed by the compressor 31 (a→b). In the adsorption circuit 12, the adsorbent is pressurized by the pressurizer 41 (a'→b'). Accordingly, the pressures of the refrigerant and adsorbent rise from pL to pH. In this process, a part Q1 of heat generated by adiabatic compression of the refrigerant is given to the adsorbent. In other words, the refrigerant gives heat to the adsorbent while being compressed, thereby being cooled. As a result, the temperatures of the refrigerant and adsorbent rise from TL to TH.

Subsequently, in the adsorption section 21, the refrigerant is gradually adsorbed by the adsorbent while releasing heat Q2 (b'→c'). In this process, the adsorption amount of the adsorbent increases from mL to mH. As a result, in the adsorption section 21, most of the refrigerant in the refrigerant circuit 11 is adsorbed by the adsorbent in the adsorption circuit 12. As indicated by hatched arrows in the adsorption section 21 in FIG. 1, in the adsorption section 21, the refrigerant in the refrigerant circuit 11 moves to the adsorption circuit 12 and is adsorbed by the adsorbent.

Subsequently, in the adsorption circuit 12, the adsorbent is depressurized by the depressurizer 42 (c'→d'). Accordingly, the pressure of the adsorbent drops from pH to pL. In this process, isenthalpic expansion of the refrigerant desorbed from the adsorbent causes the temperature of the adsorbent to drop from TH to TL. Due to the difference in temperature between the refrigerant and the adsorbent, the depressurized adsorbent in the adsorption circuit 12 is cooled to give heat Q3 to the refrigerant in the refrigerant circuit 11. The heat exchanger 43 causes heat Q5 to be given from the adsorbent that has not yet been depressurized to the adsorbent that has not yet been pressurized.

Subsequently, in the desorption section 22, the refrigerant is gradually desorbed from the adsorbent while absorbing heat Q4 (d'→a'). In this process, the adsorption amount of the adsorbent decreases from mH to mL. As a result, most of the refrigerant adsorbed by the adsorbent in the adsorption circuit 12 is desorbed and flows into the refrigerant circuit 11. As indicated by hatched arrows in the desorption section 22 in FIG. 1, in the desorption section 22, the refrigerant desorbed from the adsorbent in the adsorption circuit 12 moves to the refrigerant circuit 11.

As illustrated in FIG. 2, in an adsorption process (b'→c') in which the refrigerant is adsorbed by the adsorbent, the pressure is pH, and the adsorption amount of the adsorbent increases from mL to mH. In a desorption process (d'→a') in which the refrigerant is desorbed from the adsorbent, the pressure is pL, and the adsorption amount of the adsorbent decreases from mH to mL. As illustrated in FIG. 3, the enthalpy decreases by Δh1 in the adsorption process. In the desorption process, the enthalpy increases by Δh2. In the adsorption process, the heat Q2 released from the adsorption section 21 is proportional to Δh1. In the desorption process, the heat Q4 absorbed by the desorption section 22 is proportional to Δh2.

The amount of change in the enthalpy resulting from heat exchange by the heat exchanger 43 is represented by Δh3. In the pressurization process of the adsorbent (a'→b'), the amount of change in the enthalpy resulting from the adsorbent being heated is represented by Δh4. In the depressurization process of the adsorbent (c'→d'), the amount of change in the enthalpy resulting from the adsorbent being cooled is represented by Δh5. As illustrated in FIG. 4, the amount of change in the total enthalpy in the compression process of the refrigerant (a→b) is represented by Δh4-Δh3. The amount of change in the total enthalpy in the depressurization process of the adsorbent (c'→d') is represented by Δh5-Δh3. In FIG. 4, a change in the state of the refrigerant during adiabatic compression is indicated by a broken-line arrow, and a change in the state of the refrigerant during isenthalpic expansion is indicated by a dot-and-dash-line arrow.

Figure 5:
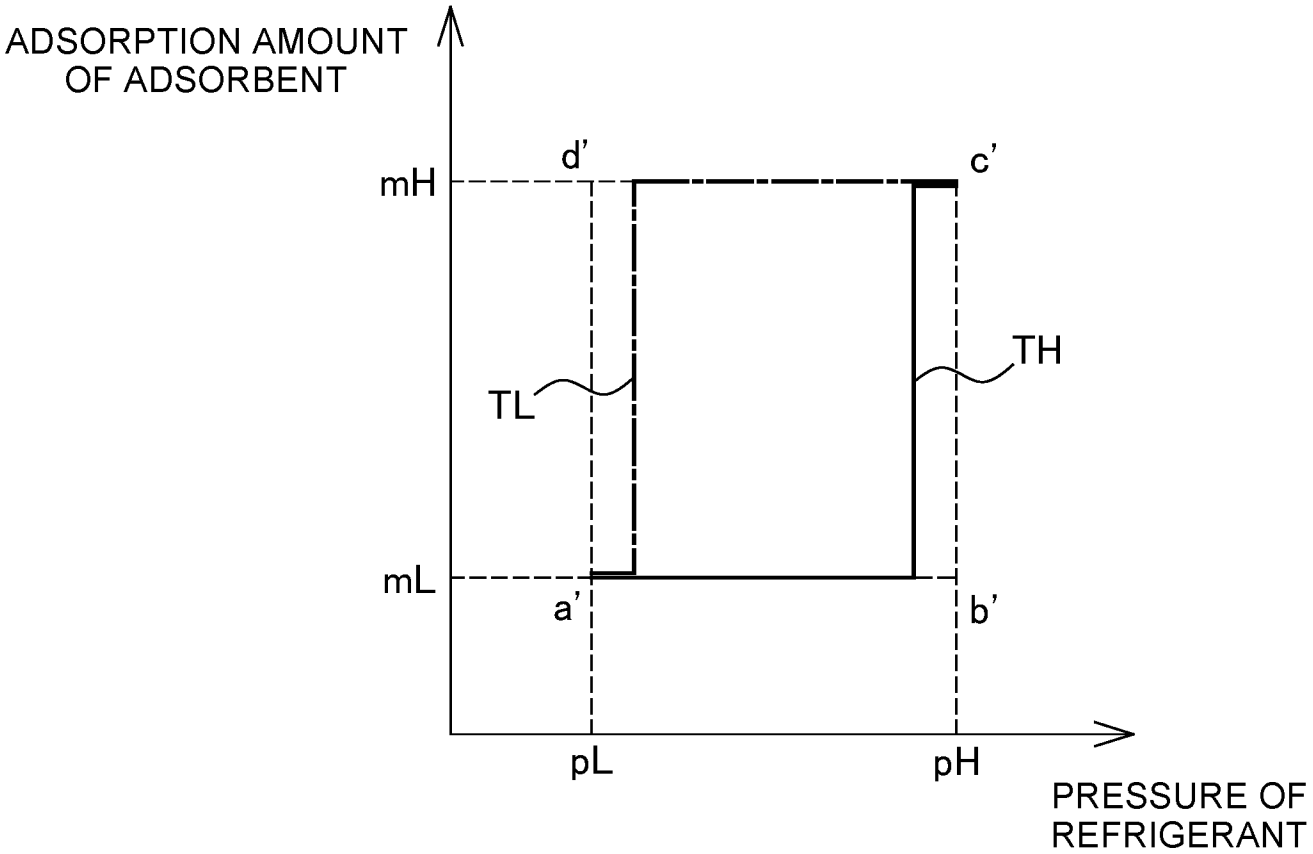
FIG. 5 is a graph illustrating isotherms of a refrigerant adsorbed by an adsorbent.

FIG. 5 illustrates isotherms during adsorption and desorption of the refrigerant that are suitable for the heat pump cycle of the refrigeration cycle apparatus 1. In FIG. 5, the isotherm at the temperature TH is indicated by a solid line, and the isotherm at the temperature TL is indicated by a dot-and-dash line. In the adsorption process (b'→c'), when the refrigerant is adsorbed by the adsorbent at the pressure pH and the temperature TH, the isotherm at the temperature TH is preferably such that the adsorption amount of the adsorbent increases from mL to mH at a pressure between pL and pH. In the desorption process (d'→a'), when the refrigerant is desorbed from the adsorbent at the pressure pL and the temperature TL, the isotherm at the temperature IL is preferably such that the adsorption amount of the adsorbent decreases from mHI to mL at a pressure between pL and pH.

(3) Detailed Configuration

A specific configuration of the refrigeration cycle apparatus 1 illustrated in FIG. 1 will be described with reference to FIG. 6.

Figure 6:
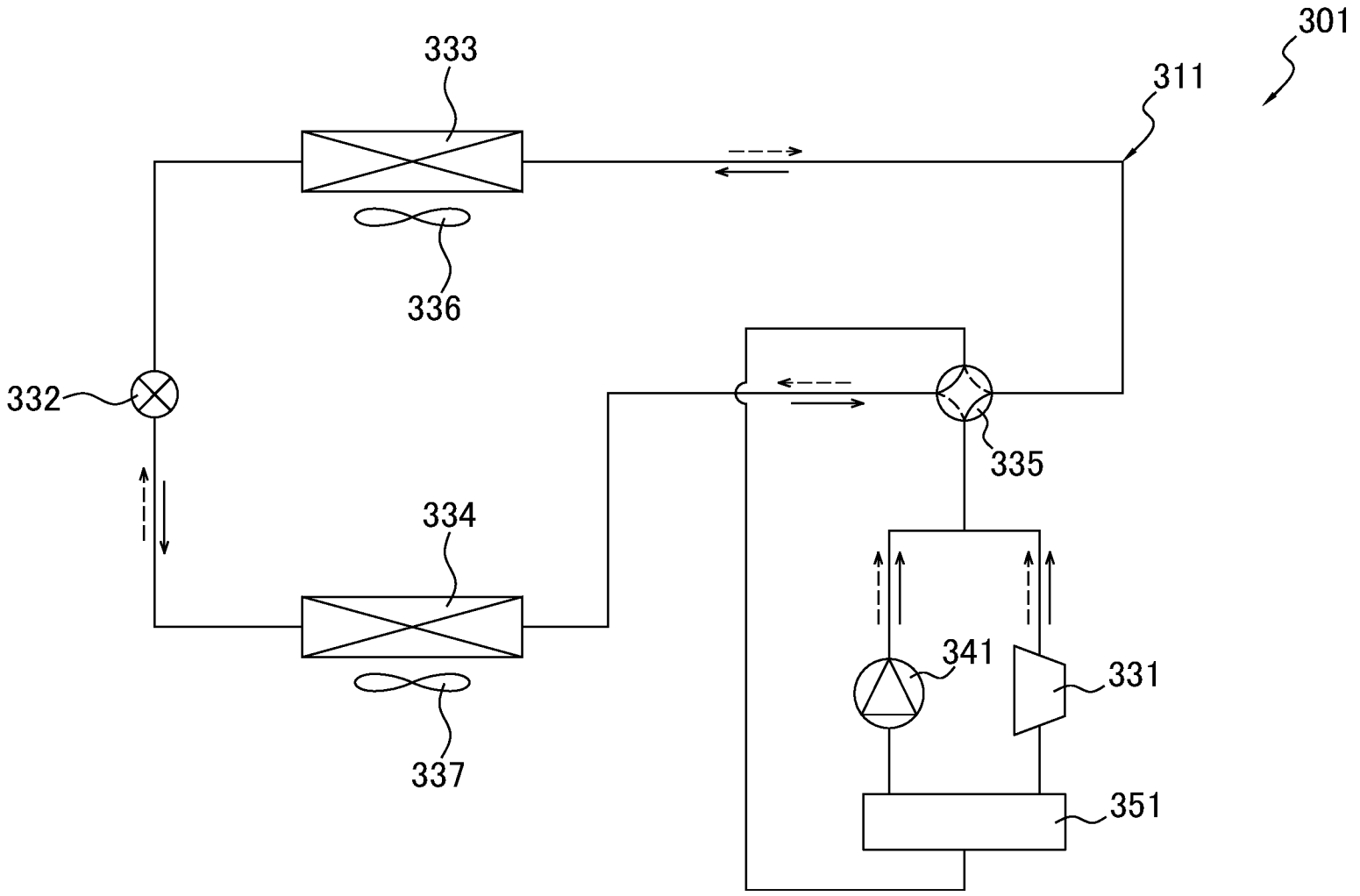
FIG. 6 is a configuration diagram of an example of the refrigeration cycle apparatus.

A refrigeration cycle apparatus 301 illustrated in FIG. 6 includes a refrigerant circuit 311 in which a refrigerant circulates. The refrigerant circuit 311 has the functions of both the refrigerant circuit 11 and the adsorption circuit 12 in FIG. 1. An adsorbent flows in a part of the refrigerant circuit 311 together with the refrigerant. In other words, in the refrigeration cycle apparatus 301, a mixture of the refrigerant and the adsorbent circulates in the refrigerant circuit 311.

The refrigerant circuit 311 includes a compressor 331, an expansion mechanism 332, a first heat exchanger 333, a second heat exchanger 334, a switcher 335, a first fan 336, a second fan 337, a pressurizer 341, and a separator 351. The compressor 331 corresponds to the compressor 31 in FIG. 1. The pressurizer 341 corresponds to the pressurizer 41 in FIG. 1. The expansion mechanism 332 has the functions of both the expansion mechanism 32 and the depressurizer 42 in FIG. 1.

The switcher 335 switches the flow direction of the mixture of the refrigerant and the adsorbent circulating in the refrigerant circuit 311. The switcher 335 is, for example, a four-way switching valve. The switcher 335 switches between a first mode of the flow direction indicated by solid lines in FIG. 6 and a second mode of the flow direction indicated by broken lines in FIG. 6. In the first mode, the discharge sides of the compressor 331 and the pressurizer 341 are connected to the first heat exchanger 333, and the suction sides of the compressor 331 and the pressurizer 341 are connected to the second heat exchanger 334. In the second mode, the discharge sides of the compressor 331 and the pressurizer 341 are connected to the second heat exchanger 334, and the suction sides of the compressor 331 and the pressurizer 341 are connected to the first heat exchanger 333.

The separator 351 is provided between the switcher 335 and the suction sides of the compressor 331 and the pressurizer 341.

The separator 351 separates the mixture of the refrigerant in the low-pressure region and the adsorbent circulating in the refrigerant circuit 311 into the refrigerant and the adsorbent. The separator 351 performs separation into the refrigerant and the adsorbent by, for example, centrifugal separation. The refrigerant separated by the separator 351 is compressed by the compressor 331. The adsorbent separated by the separator 351 is pressurized by the pressurizer 341. As illustrated in FIG. 6, the adsorbent pressurized by the pressurizer 341 merges with the refrigerant compressed by the compressor 331, After being merged, the refrigerant and the adsorbent are sent to the switcher 335, In this way, the refrigerant circuit 311 branches at the separator 351 and merges between the compressor 331/pressurizer 341 and the switcher 335.

In the first heat exchanger 333, a high-pressure refrigerant is adsorbed by the adsorbent in the first mode, and a low-pressure refrigerant is desorbed from the adsorbent in the second mode. In the second heat exchanger 334, a low-pressure refrigerant is desorbed from the adsorbent in the first mode, and a high-pressure refrigerant is adsorbed by the adsorbent in the second mode. In the first heat exchanger 333 and the second heat exchanger 334, the refrigerant is adsorbed by the adsorbent so as to be heated, or the refrigerant is desorbed from the adsorbent so as to be cooled. As a result, heat exchange is performed between the heated or cooled refrigerant and air in the first heat exchanger 333 and the second heat exchanger 334. The first fan 336 sends the air that has exchanged heat in the first heat exchanger 333 to a predetermined place. The second fan 337 sends the air that has exchanged heat in the second heat exchanger 334 to a predetermined place.

As described above, in the refrigeration cycle apparatus 301, in the process in which the mixture of the refrigerant and the adsorbent circulates in the refrigerant circuit 311, the refrigerant is heated or cooled, and the air that has exchanged heat with the refrigerant is sent to a predetermined place. A description will be given of a case where the refrigeration cycle apparatus 301 is an air conditioning apparatus. It is assumed that the first heat exchanger 333 is an indoor heat exchanger and the second heat exchanger 334 is an outdoor heat exchanger. When the refrigeration cycle apparatus 301 performs a heating operation, switching to the first mode causes the refrigerant to be adsorbed by the adsorbent and to be heated in the first heat exchanger 333. The air heated by heat exchange with the refrigerant is sent to a predetermined place by the first fan 336.

The refrigeration cycle apparatus 301 may further include a member that separates a mixture of the refrigerant in the high-pressure region and the adsorbent circulating in the refrigerant circuit 311 into the refrigerant and the adsorbent. In this case, the separated refrigerant is decompressed by a member corresponding to the expansion mechanism 332 in FIG. 6, and the separated adsorbent is depressurized by a member corresponding to the depressurizer 42 in FIG. 1.

The specific configuration of the refrigeration cycle apparatus 1 illustrated in FIG. 1 is not limited to the refrigeration cycle apparatus 301 illustrated in FIG. 6. For example, the refrigeration cycle apparatus 1 need not include members corresponding to the pressurizer 341 and the separator 351 of the refrigeration cycle apparatus 301, and may include one circuit in which a mixture of the refrigerant and the adsorbent circulates.

Alternatively, the refrigeration cycle apparatus 1 may include two circuits composed of a refrigerant circuit in which a refrigerant circulates and an adsorbent circuit in which an adsorbent circulates. In this case, the refrigeration cycle apparatus 1 has a configuration for allowing the refrigerant flowing in the refrigerant circuit to freely enter and exit the adsorbent circuit. For example, the refrigeration cycle apparatus 1 includes a mixer in which the refrigerant circuit and the adsorbent circuit are separated by a gas permeable film that allows the refrigerant to pass therethrough and does not allow the adsorbent to pass therethrough. The mixer corresponds to the adsorption section 21 and the desorption section 22 illustrated in FIG. 1. In the mixer, the refrigerant and the adsorbent are mixed, and the refrigerant is adsorbed or desorbed.

The refrigeration cycle apparatus 1 may have a configuration in which two adsorption sections (a first adsorption section and a second adsorption section) are provided in the refrigerant circuit in which a refrigerant circulates. The first adsorption section and the second adsorption section include an adsorbent that comes into contact with the refrigerant circulating in the refrigerant circuit. In this case, the refrigeration cycle apparatus 1 has a configuration capable of switching between a first mode in which a first adsorbent adsorbs the refrigerant and a second adsorbent desorbs the refrigerant and a second mode in which the first adsorbent desorbs the refrigerant and the second adsorbent adsorbs the refrigerant.

(4) Operation Conditions

Figure 7:
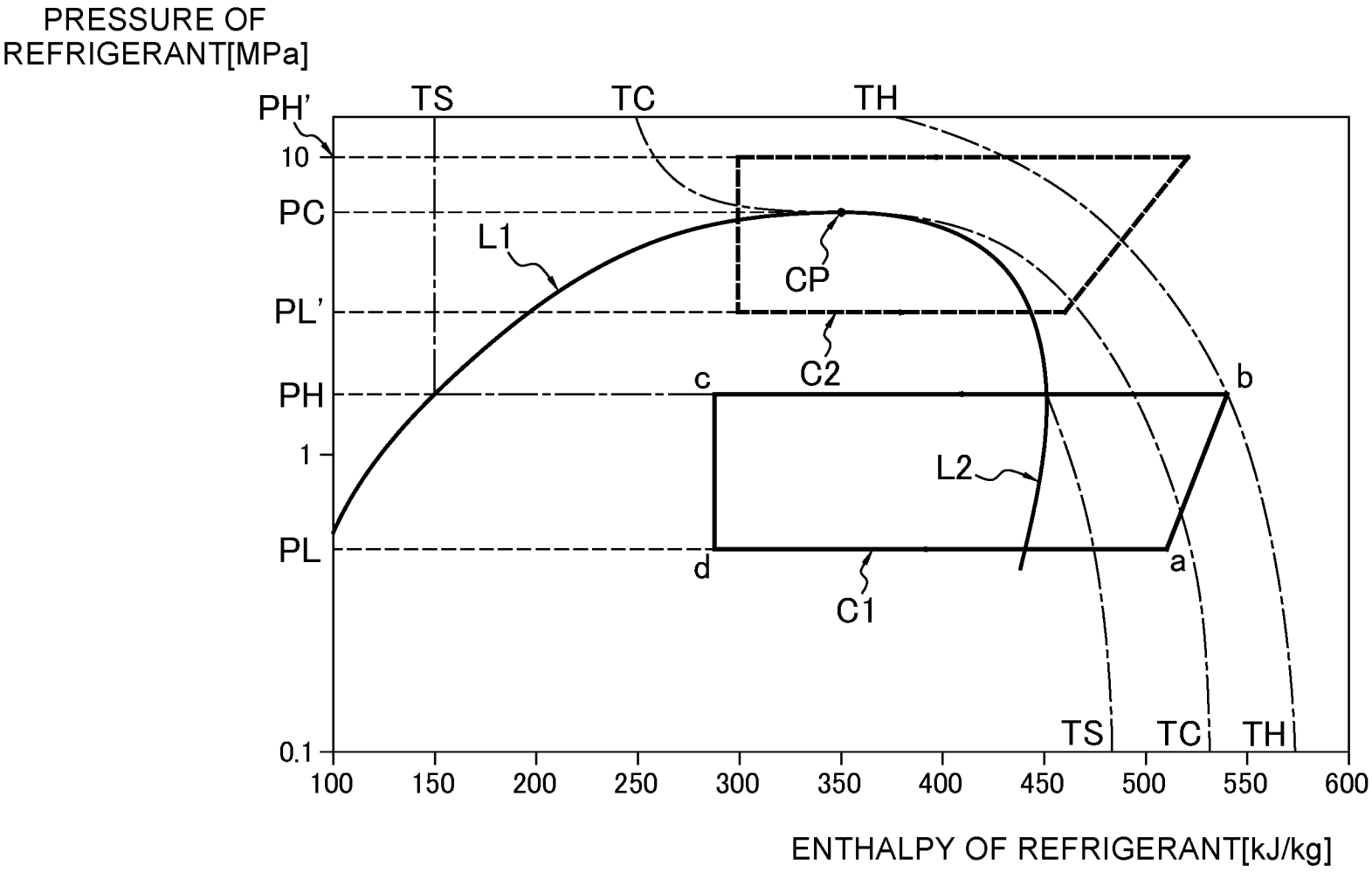
FIG. 7 is a Mother diagram of a refrigerant in a first example.
Figure 8:
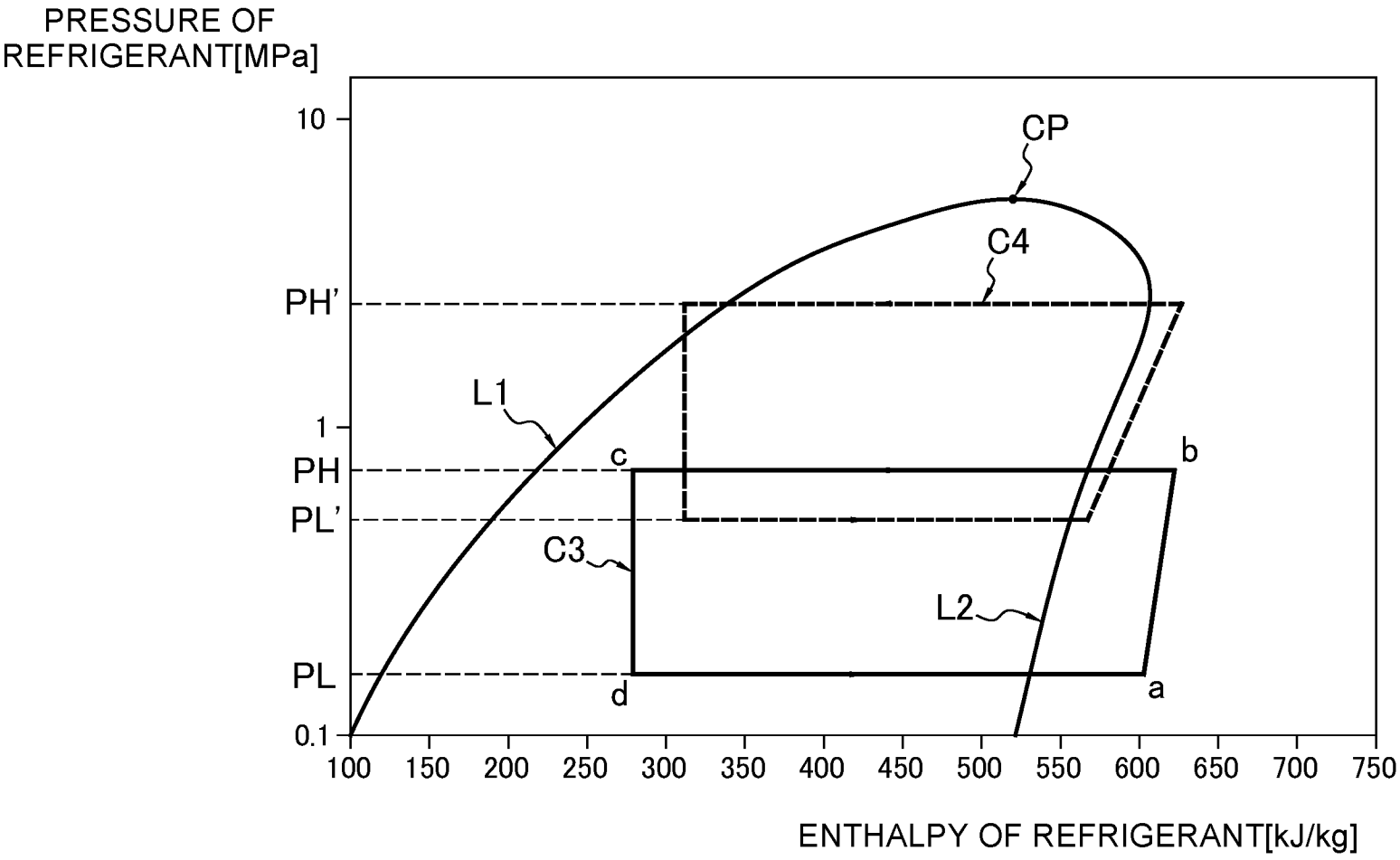
FIG. 8 is a Mother diagram of a refrigerant in a second example.

The refrigeration cycle apparatus 1 is operated such that at least one of a first condition and a second condition is satisfied. Next, specific examples of the first condition and the second condition will be described with reference to Mollier diagrams (p-h diagrams) illustrating the state of a refrigerant in a refrigeration cycle. In FIG. 7 and FIG. 8, a saturated liquid line L1, a dry saturated vapor line L2, and a critical point CP of a refrigerant are drawn. The critical point CP is an end point on the high-pressure side of the saturated liquid line L1 and the dry saturated vapor line L2. In FIG. 7, the isotherms at temperatures TH, IC, and TS are each drawn by a dot-and-dash line.

(4-1) First Example

In the present example, the refrigerant used by the refrigeration cycle apparatus 1 is carbon dioxide. The first condition and the second condition are as follows.

First condition: the refrigerant in the high-pressure region has a pressure lower than or equal to the critical pressure of the refrigerant, and the refrigerant in the high-pressure region has a temperature exceeding the critical temperature of the refrigerant.

Second condition: the refrigerant in the low-pressure region has a pressure lower than a saturation pressure corresponding to an evaporation temperature of the refrigerant in a case where the adsorbent neither adsorbs nor desorbs the refrigerant.

In FIG. 7, a refrigeration cycle C1 of the refrigeration cycle apparatus 1 is indicated by a solid line, and a refrigeration cycle C2 of a refrigeration cycle apparatus including only a vapor compression cycle is indicated by a broken line. In the refrigeration cycle C1, the individual states of the refrigerant cycle a→b→c→d→a in the refrigerant circuit 11 in FIG. 1 are shown.

In the first condition, the pressure PH of the refrigerant in the high-pressure region in the refrigeration cycle C1 is lower than or equal to the critical pressure PC of the refrigerant. The critical pressure PC is the pressure at the critical point CP. In the first condition, the temperature TH of the refrigerant in the high-pressure region in the refrigeration cycle C1 exceeds the critical temperature TC of the refrigerant. The temperature TH is the temperature of the high-temperature and high-pressure refrigerant compressed by the compressors 31, and is the temperature of the refrigerant in the state b of the refrigeration cycle C1, The critical temperature IC is the temperature at the critical point CP. In FIG. 7, the temperature TH indicated by the isotherm passing through the state b is higher than the temperature TC indicated by the isotherm passing through the critical point CP.

In the second condition, the pressure PL of the refrigerant in the low-pressure region in the refrigeration cycle C1 is lower than a saturation pressure PL' corresponding to an evaporation temperature of the refrigerant in a case where the adsorbent neither adsorbs nor desorbs the refrigerant. The saturation pressure PL' corresponds to the pressure in the low-pressure region in the refrigeration cycle C2.

The value of the pressure PH of the refrigerant in the high-pressure region in the refrigeration cycle C1 may be set as appropriate. For example, in a vapor compression refrigeration cycle in which R32 circulates, the pressure PH is set to be lower than or equal to a saturation pressure corresponding to 6° C. of R32. In a vapor compression refrigeration cycle in which R134a circulates, the pressure PH is set to be lower than or equal to a saturation pressure corresponding to 65° C. of R134a.

(4-2) Second Example

In the present example, the refrigerant used by the refrigeration cycle apparatus 1 is propane. The first condition and the second condition are as follows.

First condition: the refrigerant in the high-pressure region has a pressure lower than a saturation pressure corresponding to a condensation temperature of the refrigerant in a case where the adsorbent neither adsorbs nor desorbs the refrigerant.

Second condition: the refrigerant in the low-pressure region has a pressure lower than a saturation pressure corresponding to an evaporation temperature of the refrigerant in a case where the adsorbent neither adsorbs nor desorbs the refrigerant.

In FIG. 8, a refrigeration cycle C3 of the refrigeration cycle apparatus 1 is indicated by a solid line, and a refrigeration cycle C4 of a refrigeration cycle apparatus including only a vapor compression cycle is indicated by a broken line. In the refrigeration cycle C3, the individual states of the refrigerant cycle a→b→c→d→a in the refrigerant circuit 11 in FIG. 1 are shown.

In the first condition, the pressure PH of the refrigerant in the high-pressure region in the refrigeration cycle C3 is lower than a saturation pressure PH' corresponding to a condensation temperature of the refrigerant in a case where the adsorbent neither adsorbs nor desorbs the refrigerant.

The saturation pressure PH' corresponds to the pressure in the high-pressure region in the refrigeration cycle C4.

In the second condition, the pressure PL of the refrigerant in the low-pressure region in the refrigeration cycle C3 is lower than the saturation pressure PL' corresponding to an evaporation temperature of the refrigerant in a case where the adsorbent neither adsorbs nor desorbs the refrigerant. The saturation pressure PL' corresponds to the pressure in the low-pressure region in the refrigeration cycle C4.

(5) Features

In FIG. 7 and FIG. 8, the operating pressure of the refrigeration cycle apparatus 1 is PH, and the operating pressure of the existing refrigeration cycle apparatus is PH'. The operating pressure PH is lower than the operating pressure PH'. Thus, the refrigeration cycle apparatus 1 has a lower operating pressure than the existing refrigeration cycle apparatus that has a vapor compression refrigeration cycle and does not have an adsorbent. For example, when the refrigerant is carbon dioxide, the operating pressure PH' of the existing refrigeration cycle apparatus is about 10 MPa, whereas the operating pressure PH of the refrigeration cycle apparatus 1 is about 1.5 MPa, as illustrated in FIG. 7. An operating pressure is the pressure of a compressed refrigerant in a refrigeration cycle. As the operating pressure increases, the mechanical work load of the compressor increases, and the withstand pressure (design pressure) required for members constituting the refrigerant circuit, such as the casing of the compressor, increases. Thus, as the operating pressure increases, the cost of electric power for driving the compressor and the cost of members constituting the system tend to increase.

Thus, the refrigeration cycle apparatus 1 can be operated at an operating pressure lower than that of the existing refrigeration cycle apparatus, and thus the manufacturing cost and the operation cost can be reduced. In addition, in the refrigeration cycle apparatus 1, the lower design pressure makes it possible to make members such as the casing of the compressor compact, and improve the reliability of the system.

In addition, when the refrigeration cycle apparatus 1 is an air conditioning apparatus, the refrigeration cycle apparatus 1 is capable of increasing the cooling and heating capacity by using the adsorption heat and the desorption heat of the refrigerant for cooling and heating. Thus, as a result of controlling the adsorption heat and the desorption heat of the refrigerant, the refrigeration cycle apparatus 1 is capable of improving the efficiency of the refrigeration cycle and reducing the operation cost as compared with the existing refrigeration cycle apparatus.

(6) Modifications (6-1) Modification A

In the first example, the first condition may be a condition in which the refrigerant in the high-pressure region has a pressure lower than or equal to the critical pressure of the refrigerant, and the refrigerant in the high-pressure region has a temperature exceeding the saturation temperature of the refrigerant corresponding to the pressure of the refrigerant in the high-pressure region.

In the first condition, the pressure PH of the refrigerant in the high-pressure region in the refrigeration cycle C1 is lower than or equal to the critical pressure PC of the refrigerant. In addition, the temperature TH of the refrigerant in the high-pressure region in the refrigeration cycle C1 exceeds the saturation temperature TS of the refrigerant corresponding to the pressure of the refrigerant in the high-pressure region. The temperature TH is the temperature of the high-temperature and high-pressure refrigerant compressed by the compressors 31, and is the temperature of the refrigerant in the state b of the refrigeration cycle C1. As illustrated in FIG. 7, the saturation temperature TS corresponds to the temperature at the point where the line of the pressures PH of the refrigerant in the high-pressure region in the refrigeration cycle C1 and the dry saturated vapor line L2 intersect.

(6-2) Modification B

In the second example, the refrigerant used by the refrigeration cycle apparatus 1 may be ammonia.

(6-3) Modification C

The adsorbent used in the refrigeration cycle apparatuses 1 and 301 is a metal-organic framework. Alternatively, a material other than a metal-organic framework may be used as the adsorbent.

The embodiment of the present disclosure has been described above. It is to be understood that the embodiment and the details can be variously changed without deviating from the gist and scope of the present disclosure described in the claims.

The invention claimed is:

1. A refrigeration cycle apparatus comprising:

a first unit including a compressor configured to compress a refrigerant and an expansion mechanism configured to decompress the refrigerant, the first unit configuring a vapor compression refrigeration cycle in which the refrigerant circulates; and an adsorbent configured to adsorb and desorb the refrigerant circulating in the first unit, wherein the first unit further includes a high-pressure region in which the refrigerant that has been compressed by the compressor and that has not yet been decompressed by the expansion mechanism flows, and a low-pressure region in which the refrigerant that has been decompressed by the expansion mechanism and that has not yet been compressed by the compressor flows, and the first unit is configured to in a first condition in which the refrigerant in the high-pressure region has a pressure lower than or equal to a critical pressure of the refrigerant, and the refrigerant in the high-pressure region has a temperature exceeding a critical temperature of the refrigerant, perform the vapor compression refrigeration cycle, or in a second condition in which the refrigerant in the low-pressure region has a pressure lower than a saturation pressure corresponding to an evaporation temperature of the refrigerant in a case where the adsorbent neither adsorbs nor desorbs the refrigerant, perform the vapor compression refrigeration cycle.

2. A refrigeration cycle apparatus comprising:

a first unit including a compressor configured to compress a refrigerant and an expansion mechanism configured to decompress the refrigerant, the first unit configuring a vapor compression refrigeration cycle in which the refrigerant circulates; and an adsorbent configured to adsorb and desorb the refrigerant circulating in the first unit, wherein the first unit further includes a high-pressure region in which the refrigerant that has been compressed by the compressor and that has not yet been decompressed by the expansion mechanism flows, and a low-pressure region in which the refrigerant that has been decompressed by the expansion mechanism and that has not yet been compressed by the compressor flows, and the first unit is configured to in a first condition in which the refrigerant in the high-pressure region has a pressure lower than or equal to a critical pressure of the refrigerant, and the refrigerant in the high-pressure region has a temperature exceeding a saturation temperature of the refrigerant corresponding to the pressure of the refrigerant in the high-pressure region, perform the vapor compression refrigeration cycle, or in a second condition in which the refrigerant in the low-pressure region has a pressure lower than a saturation pressure corresponding to an evaporation temperature of the refrigerant in a case where the adsorbent neither adsorbs nor desorbs the refrigerant, perform the vapor compression refrigeration cycle.

3. The refrigeration cycle apparatus according to claim 2, wherein the refrigerant in the high-pressure region has a pressure lower than or equal to a saturation pressure corresponding to 65° C. of R32 in a vapor compression refrigeration cycle in which the R32 circulates.

4. The refrigeration cycle apparatus according to claim 2, wherein the refrigerant in the high-pressure region has a pressure lower than or equal to a saturation pressure corresponding to 65° C. of R134a in a vapor compression refrigeration cycle in which the R134a circulates.

5. The refrigeration cycle apparatus according to claim 2, wherein the adsorbent includes a metal-organic framework including a metal ion and an organic ligand.

6. The refrigeration cycle apparatus according to claim 2, wherein the refrigerant is carbon dioxide.

7. A refrigeration cycle apparatus comprising:

a first unit including a compressor configured to compress a refrigerant and an expansion mechanism configured to decompress the refrigerant, the first unit configuring a vapor compression refrigeration cycle in which the refrigerant circulates; and an adsorbent configured to adsorb and desorb the refrigerant circulating in the first unit, wherein the first unit further includes a high-pressure region in which the refrigerant that has been compressed by the compressor and that has not yet been decompressed by the expansion mechanism flows, and a low-pressure region in which the refrigerant that has been decompressed by the expansion mechanism and that has not yet been compressed by the compressor flows, and the first unit is configured to in a first condition in which the refrigerant in the high-pressure region has a pressure lower than a saturation pressure corresponding to a condensation temperature of the refrigerant in a case where the adsorbent neither adsorbs nor desorbs the refrigerant perform the vapor compression refrigeration cycle, or in a second condition in which the refrigerant in the low-pressure region has a pressure lower than a saturation pressure corresponding to an evaporation temperature of the refrigerant in a case where the adsorbent neither adsorbs nor desorbs the refrigerant perform the vapor compression refrigeration cycle.

8. The refrigeration cycle apparatus according to claim 7, wherein the adsorbent includes a metal-organic framework including a metal ion and an organic ligand.

9. The refrigeration cycle apparatus according to claim 7, wherein the refrigerant is ammonia or propane.

* * * * *